US010517348B2

(12) United States Patent
Rong et al.

(10) Patent No.: US 10,517,348 B2
(45) Date of Patent: Dec. 31, 2019

(54) CYCLING HELMET CAPABLE OF SWITCHING SOUND PRODUCTION GUIDANCE MODE BASED ON BONE CONDUCTION EARPHONE

(71) Applicants: DONGGUANG YUANFENG TECHNOLOGY CO., LTD., Dongguan (CN); GUANGDONG YUANFENG ELECTRONIC TECHNOLOGY CO., LTD., Dongguan (CN)

(72) Inventors: Eric Rong, Dongguan (CN); Xin Zhong, Dongguan (CN); Rijian Shi, Dongguan (CN); Xiaochun Xiao, Dongguan (CN); Donghong Wang, Dongguan (CN)

(73) Assignees: DONGGUANG YUANFENG TECHNOLOGY CO., LTD., Dongguan (CN); GUANGDONG YUANFENG ELECTRONIC TECHNOLOGY CO., LTD., Dongguan (CN)

( * ) Notice: Subject to any disclaimer, the term of this patent is extended or adjusted under 35 U.S.C. 154(b) by 89 days.

(21) Appl. No.: 15/551,422

(22) PCT Filed: Dec. 14, 2015

(86) PCT No.: PCT/CN2015/097263

§ 371 (c)(1),
(2) Date: Aug. 16, 2017

(87) PCT Pub. No.: WO2017/016138

PCT Pub. Date: Feb. 2, 2017

(65) Prior Publication Data

US 2018/0279710 A1 Oct. 4, 2018

(30) Foreign Application Priority Data

Jul. 29, 2015 (CN) ..... 2015 1 0456106

(51) Int. Cl.

| | |
|---|---|
| ***A42B 3/30*** | (2006.01) |
| ***A42B 3/06*** | (2006.01) |
| ***H04R 1/10*** | (2006.01) |

(52) U.S. Cl.

CPC ..... *A42B 3/30* (2013.01); *A42B 3/306* (2013.01); *H04R 1/10* (2013.01); *A42B 3/066* (2013.01);

(Continued)

(58) Field of Classification Search

CPC ..... A42B 3/30; A42B 3/306; A42B 3/303; A42B 3/066; A42B 3/04; H04R 2460/13;

(Continued)

(56) References Cited

U.S. PATENT DOCUMENTS 5,404,577 A * 4/1995 Zuckerman ..... A42B 3/30 455/351
6,456,721 B1 * 9/2002 Fukuda ..... H04R 1/1066 381/151

(Continued)

FOREIGN PATENT DOCUMENTS

CN 1976540 A 6/2007
CN 103141116 A 6/2013

(Continued)

OTHER PUBLICATIONS

International Search Report, International Application No. PCT/CN2015/097263, pp. 1-6, International Filing Date Dec. 14, 2015, dated Apr. 26, 2016.

(Continued)

*Primary Examiner* — Amy Vanatta
(74) *Attorney, Agent, or Firm* — Bond, Schoeneck & King, PLLC; George McGuire

(57) ABSTRACT

A cycling helmet capable of switching a sound production guidance mode based on a bone conduction earphone includes: a helmet body and the bone conduction earphone disposed on the helmet body. The bone conduction earphone includes a magnet, a coil and a bone conduction oscillator, and the bone conduction oscillator can contact the helmet body, so as to cause the helmet body to oscillate to form a sound cavity.

4 Claims, 7 Drawing Sheets

(52) U.S. Cl.
CPC ..... *H04R 1/1041* (2013.01); *H04R 2201/023* (2013.01); *H04R 2201/107* (2013.01); *H04R 2460/13* (2013.01)

(58) Field of Classification Search
CPC ..... H04R 1/10; H04R 2201/023; H04R 2201/107; H04R 1/1041; H04R 1/028; H04R 1/026; H04R 1/025; H04R 1/1066
See application file for complete search history.

(56) References Cited

U.S. PATENT DOCUMENTS

| | | | | |
|---|---|---|---|---|
| 7,010,139 | B1 * | 3/2006 | Smeehuyzen | H04R 1/10 381/376 |
| 10,064,444 | B2 * | 9/2018 | Glezerman | A42B 3/12 |
| 2004/0105566 | A1 * | 6/2004 | Matsunaga | A42B 1/245 381/381 |
| 2004/0261158 | A1 * | 12/2004 | Depew | A42B 3/14 2/422 |
| 2006/0277664 | A1 * | 12/2006 | Akhtar | A42B 3/06 2/410 |
| 2007/0098199 | A1 * | 5/2007 | Goldberg | A42B 3/30 381/376 |
| 2010/0223706 | A1 | 9/2010 | Becker et al. | |
| 2013/0180033 | A1 | 7/2013 | Uemoto et al. | |
| 2015/0130945 | A1 * | 5/2015 | Yu | H04N 7/181 348/158 |

FOREIGN PATENT DOCUMENTS

| | | | | |
|---|---|---|---|---|
| CN | 203575719 | U | 5/2014 | |
| CN | 203952570 | U | 11/2014 | |
| CN | 204070721 | U | 1/2015 | |
| CN | 205011455 | A | 11/2015 | |
| CN | 204838172 | U | 12/2015 | |
| CN | 105394862 | A | 3/2016 | |
| JP | 2004032340 | A | 1/2004 | |
| JP | 2004173018 | A | 6/2004 | |
| JP | 2005248392 | A | 9/2005 | |
| JP | 2005535233 | A | 11/2005 | |
| JP | 2007051395 | A * | 3/2007 | |
| JP | 2008236637 | A | 10/2008 | |
| WO | WO-03013300 | A1 * | 2/2003 | A42B 3/30 |
| WO | 2005091670 | A1 | 2/2008 | |
| WO | 2011051009 | A1 | 5/2011 | |
| WO | 2012039491 | A1 | 3/2012 | |
| WO | WO-2016094582 | A1 * | 6/2016 | A42B 3/30 |
| WO | 2015064340 | A1 | 3/2017 | |

OTHER PUBLICATIONS

Australian Examination Report No. 2 for standard patent application 2015404090; dated Sep. 7, 2018, pp. 1-6.

* cited by examiner

CYCLING HELMET CAPABLE OF SWITCHING SOUND PRODUCTION GUIDANCE MODE BASED ON BONE CONDUCTION EARPHONE

TECHNICAL FIELD

The present disclosure relates to the technical field of sports equipment, in particular relates to a cycling helmet, and specifically relates to a cycling helmet capable of switching a sound production guidance mode based on a bone conduction earphone.

BACKGROUND

Great injuries may be made to a head by a slip in a cycling process, and safety problems cannot be neglected as well even if a cyclist rides along a bikeway with a flat slope at a low speed. The reason for wearing a cycling helmet is very simple and also very important, that is, protecting the head and reducing injuries. Relevant data indicate that, in more than 500 cases about accidents of cycling death every year, 75% of death is due to a fatal injury on the head. Medical researches discover that 85% of head injuries can be prevented by wearing a helmet when cycling, and an injury degree and the accident death rate can be greatly reduced. A half-helmet type cycling helmet includes a helmet specialized for road (without a brim), a road and mountain dual-purpose helmet (equipped with a detachable brim) and the like.

With an increasing development of science and technology of electronic products, more and more portable communication devices and multimedia mobile terminals appear in the life of people, and a need for communication and music appreciation in the cycling process is particularly urgent. Therefore, it is a popular trend of a current product to provide an earphone for listening a sound and a microphone in a cycling device, which is increasingly appreciated by vast users. In the existing art, the above devices are usually arranged in the cycling helmet, so as to facilitate carrying and use. However, the traditional earphone insulates external sound in a using process, easily causing a potential safety hazard. Meanwhile, as for the microphone, high-speed cycling can cause great wind interference, influencing the communication quality seriously. Therefore, it is urgent to provide a cycling device capable of solving the above problems, so as to bring better user experience to the users.

SUMMARY

One object of the present disclosure is to provide a cycling helmet capable of switching a sound production guidance mode based on a bone conduction earphone, so as to realize an air conduction sound production in the helmet and increase functions of the helmet.

Another object of the prevent disclosure is to provide a cycling helmet capable of switching a sound production guidance mode based on a bone conduction earphone, so that bone conduction sound production and air conduction sound production can be optionally realized, and the user experience is improved.

Another objective of the prevent disclosure is to provide a cycling helmet capable of switching a sound production guidance mode based on a bone conduction earphone. Through disposing the bone conduction earphone in the helmet in an injection molding manner, a good contact of the bone conduction oscillator and the helmet is realized, and a sound production effect is ensured.

Another object of the prevent disclosure is to provide a cycling helmet capable of switching a sound production guidance mode based on a bone conduction earphone, in which a protective shell and a resonant shell are made of different materials, and sound conduction and a protection function for a wearer are simultaneously realized.

In order to achieve the objects, the present disclosure adopts the following technical solutions:

A cycling helmet capable of switching a sound production guidance mode based on a bone conduction earphone is provided. The cycling helmet includes a helmet body and the bone conduction earphone disposed on the helmet body, the bone conduction earphone includes a magnet, a coil and a bone conduction oscillator, and the bone conduction oscillator can contact the helmet body, so as to cause the helmet body to oscillate to form a sound cavity.

As a technical solution of the cycling helmet capable of switching the sound production guidance mode based on the bone conduction earphone, the helmet body includes a resonant shell configured to directly contact the bone conduction oscillator, and the bone conduction earphone is disposed in the resonant shell and is integrally formed with the resonant shell in an injection molding manner.

As a technical solution of the cycling helmet capable of switching the sound production guidance mode based on the bone conduction earphone, a total number of the resonant shells are more than one, the resonant shells are symmetrically arranged in the helmet body, with respect to each of the resonant shells, one bone conduction oscillator is arranged.

As a technical solution of the cycling helmet capable of switching the sound production guidance mode based on the bone conduction earphone, the total number of the resonant shells is two, and the two resonant shells are respectively arranged at positions corresponding to ears of a wearer wearing the helmet, on the helmet body.

As a technical solution of the cycling helmet capable of switching the sound production guidance mode based on the bone conduction earphone, the helmet body includes a resonant shell capable of directly contacting the bone conduction oscillator, and the bone conduction earphone is rotatably connected with the helmet body, so that the bone conduction oscillator has a first state of contacting the resonant shell and a second state of contacting a head of the wearer wearing the helmet.

As a technical solution of the cycling helmet capable of switching the sound production guidance mode based on the bone conduction earphone, the cycling helmet further includes a first rotating arm, the first rotating arm has a first end of the first rotating arm and a second end of the first rotating arm, the first end is connected with the bone conduction earphone, the second end is connected with the helmet body, and the bone conduction earphone is articulated with the helmet body via the first rotating arm.

As a technical solution of the cycling helmet capable of switching the sound production guidance mode based on the bone conduction earphone, the helmet body is provided with a containing cavity for containing the bone conduction earphone in the first state, at least one side wall of the containing cavity is a resonant shell, and in the first state, the bone conduction earphone is located in the containing cavity, and the bone conduction oscillator of the bone conduction earphone contacts the resonant shell.

As a technical solution of the cycling helmet capable of switching the sound production guidance mode based on the bone conduction earphone, the helmet body further includes a protective shell, a resonant shell is in a hemispheric structure which is suitable for the human head to wear and is disposed at an inner side of the helmet body, the protective shell is disposed outside of the resonant shell, and a side of the resonant shell, which is far away from the protective shell, is provided with a buffer layer.

As a technical solution of the cycling helmet capable of switching the sound production guidance mode based on the bone conduction earphone, the cycling helmet further includes a bone conduction microphone and a second rotating arm for connecting the bone conduction microphone and the helmet body, the second rotating arm has a first end of the second rotating arm and a second end of the second rotating arm, the first end is connected with the bone conduction microphone, the second end is connected with the helmet body, and the bone conduction microphone is articulated with the helmet body via the second rotating arm.

As a technical solution of the cycling helmet capable of switching the sound production guidance mode based on the bone conduction earphone, the first rotating arm and the second rotating arm are in an integrated structure and are articulated with the helmet body via a same articulating apparatus.

The present disclosure has the beneficial effects that: through disposing the bone conduction earphone on the helmet body, a sound playing-out function or a bone-conduction function can be optionally realized, private communication or open-type sound playing is realized, functions of the helmet are increased, and the use safety is improved. In addition, the helmet is served as an oscillation source of the air conduction sound production, so that earplugs are prevented from entering into the ears, thereby improving the use comfort degree of a user.

BRIEF DESCRIPTION OF DRAWINGS

The present disclosure is further described below in detail according to drawings and embodiments.

References in the drawings.

Figure 1:
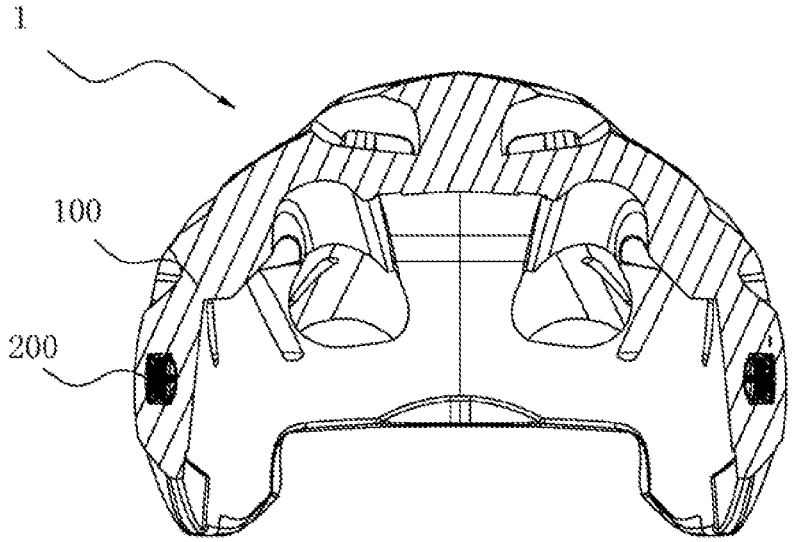
FIG. 1 is a schematic diagram illustrating an internal structure of a cycling helmet capable of switching a sound production guidance mode based on a bone conduction earphone according to embodiment I of the present disclosure.

1, helmet body; 100, protective shell; 200, bone conduction earphone; 300, resonant shell; 400, first rotating arm; 500, rotating shaft; 600, fastening screw; 700, containing cavity; 800, second rotating arm; and 900, bone conduction microphone.

DETAILED DESCRIPTION

The technical solutions of the present disclosure are further described below in combination with drawings and specific implementation manners.

It should be noted that, reference numerals in different embodiments can be universal.

Embodiment I

As shown in FIG. 1, in the present embodiment, a cycling helmet capable of switching a sound production guidance mode based on a bone conduction earphone 200, provided by the present disclosure, is an air conduction sound production cycling helmet, and includes a helmet body 1 and the bone conduction earphone 200 disposed on the helmet body 1. The bone conduction earphone 200 includes a magnet, a coil and a bone conduction oscillator, and the bone conduction oscillator can contact the helmet body 1, so that the helmet body 1 oscillates to form a sound cavity.

According to the present disclosure, the bone conduction oscillator of the bone conduction earphone 200 contacts the helmet body 1, therefore, under a situation that the bone conduction oscillator oscillates, the oscillation is transmitted from the bone conduction oscillator to the helmet body 1. As a result, the helmet body 1 oscillates to drive the air to oscillate, and the whole helmet is served as a sound production source and forms an air conduction sound production. Therefore, the helmet can realize a sound playing function when being worn on a wearer or being removed from the wearer.

As a technical solution of the cycling helmet capable of switching the sound production guidance mode based on the bone conduction earphone 200, the helmet body 1 includes a resonant shell 300 for directly contacting the bone conduction oscillator, and the bone conduction earphone 200 is located in the resonant shell 300 and is integrally formed with the resonant shell 300 in an injection molding manner.

In the technical solution of the present disclosure, the resonant shell 300 may be a head protection apparatus integrated with a protective shell 100 of the helmet body 1. The bone conduction earphone 200 is arranged in the helmet body 1 in an injection molding manner, so that a close contact of the bone conduction earphone 200 and the resonant shell 300 which finally oscillates to form the air conduction sound production is realized. Therefore, an unsatisfactory final sound production effect caused by an attenuation phenomenon of oscillation transmission between the bone conduction earphone 200 and the resonant shell 300 can be avoided when the bone conduction earphone 200 is connected with the resonant shell 300 by an external connection structure.

In order to improve the sound effect, the resonant shell 300 is made of a material with good oscillation sound production performance in a specific implementation process.

Embodiment II

Figure 2:
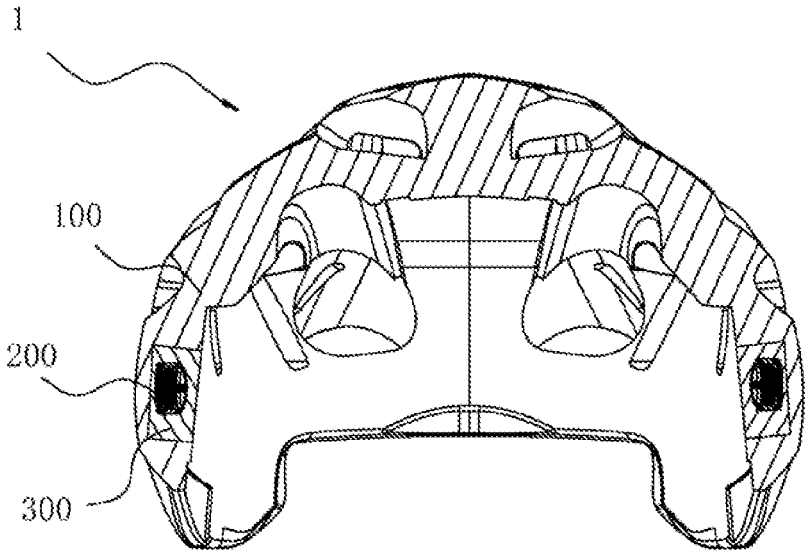
FIG. 2 is a schematic diagram illustrating an internal structure of a cycling helmet capable of switching a sound production guidance mode based on a bone conduction earphone according to embodiment II of the present disclosure.
Figure 3:
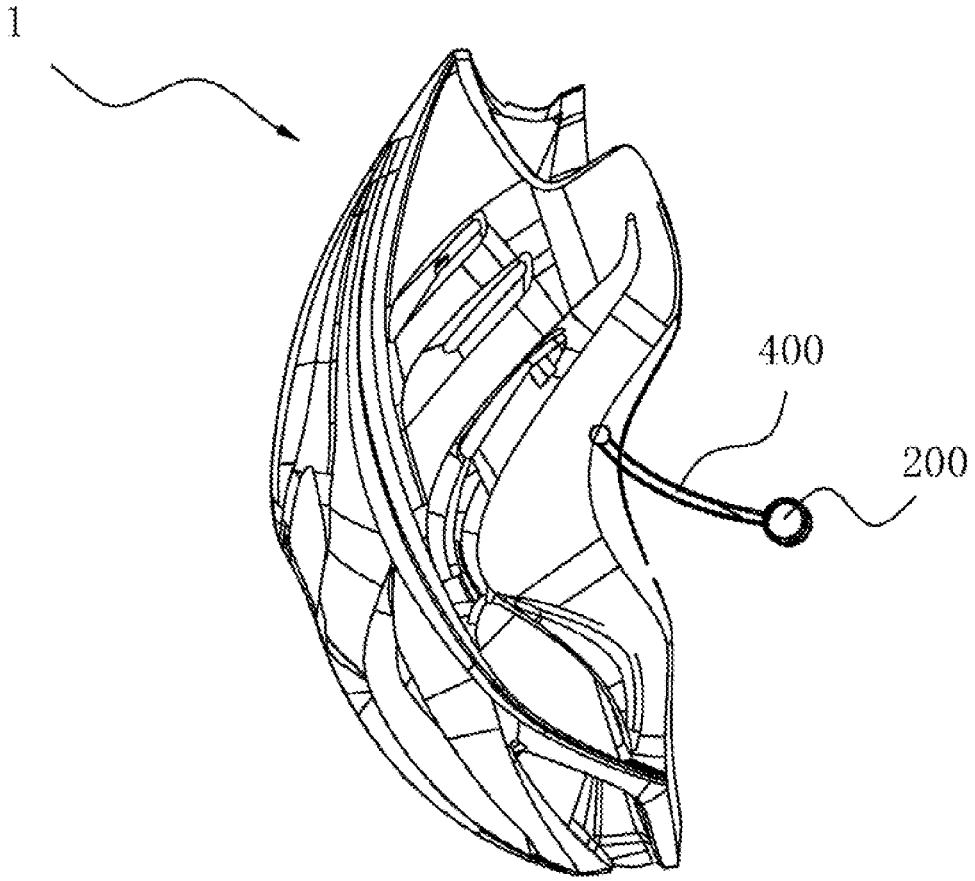
FIG. 3 is a structural schematic diagram illustrating a bone conduction earphone in a second state according to embodiment IV of the present disclosure.
Figure 4:
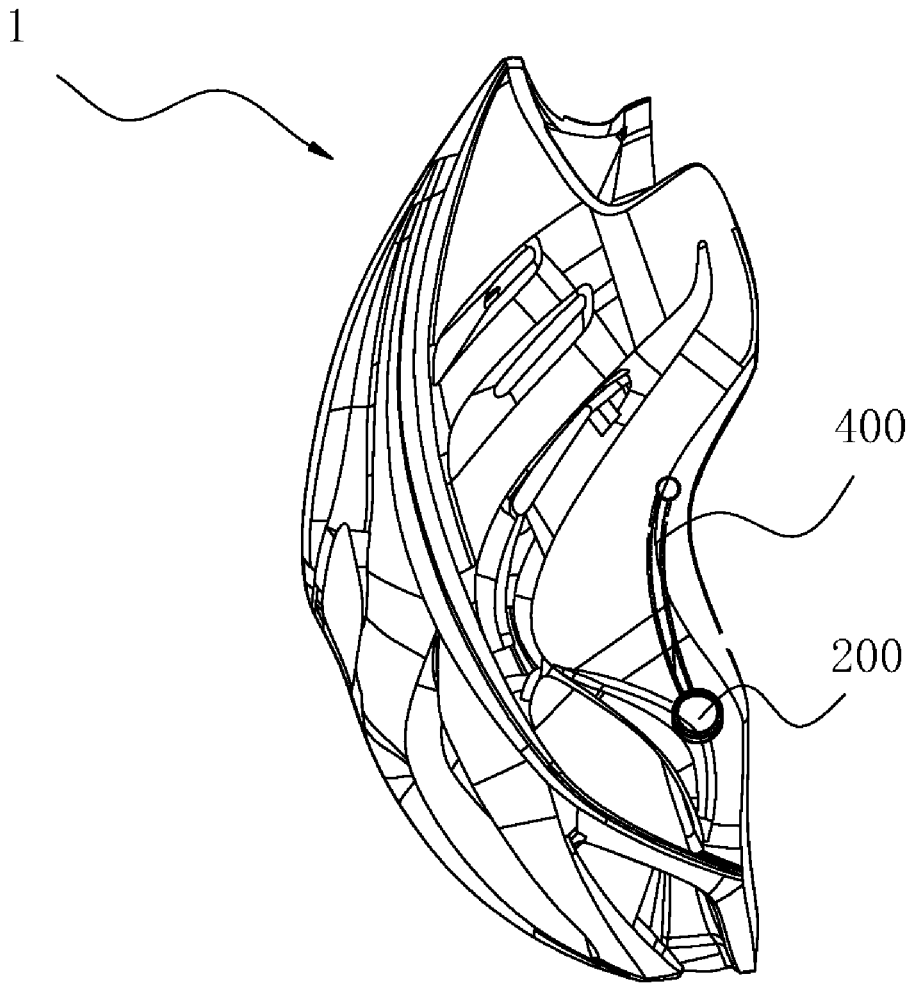
FIG. 4 is a structural schematic diagram illustrating a bone conduction earphone in a first state according to embodiment IV of the present disclosure.
Figure 5:
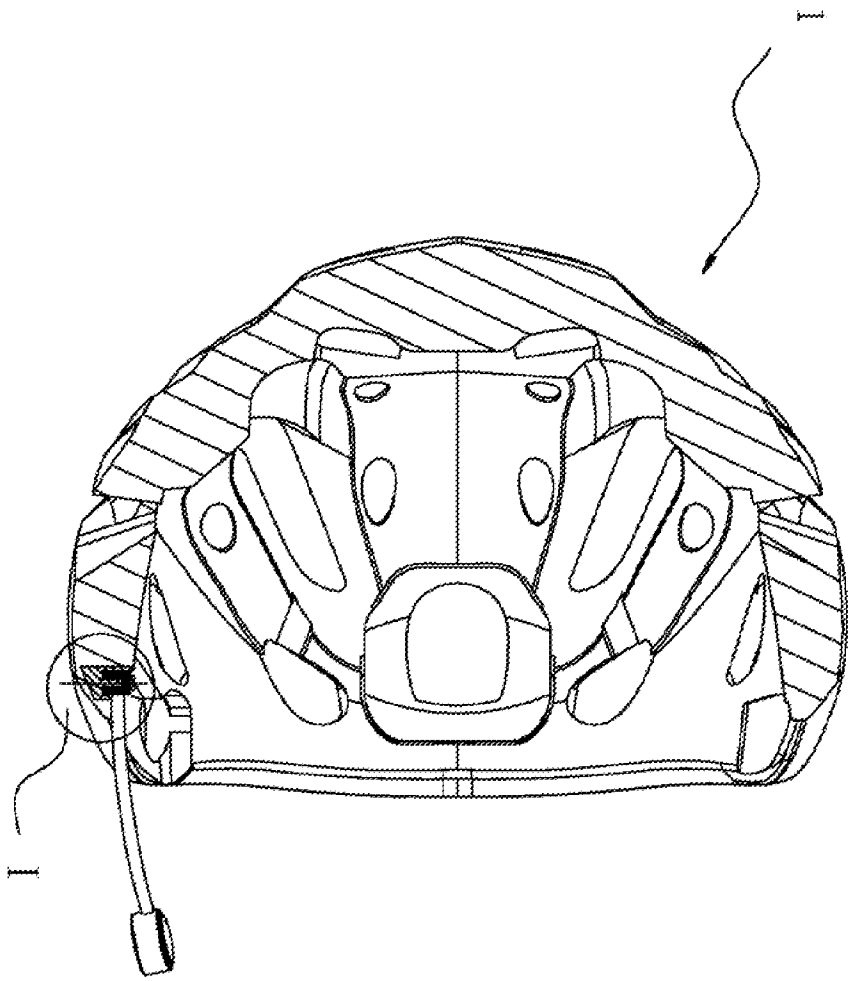
FIG. 5 is a schematic diagram illustrating an internal structure of a bone conduction earphone in a second state according to embodiment IV of the present disclosure.
Figure 6:
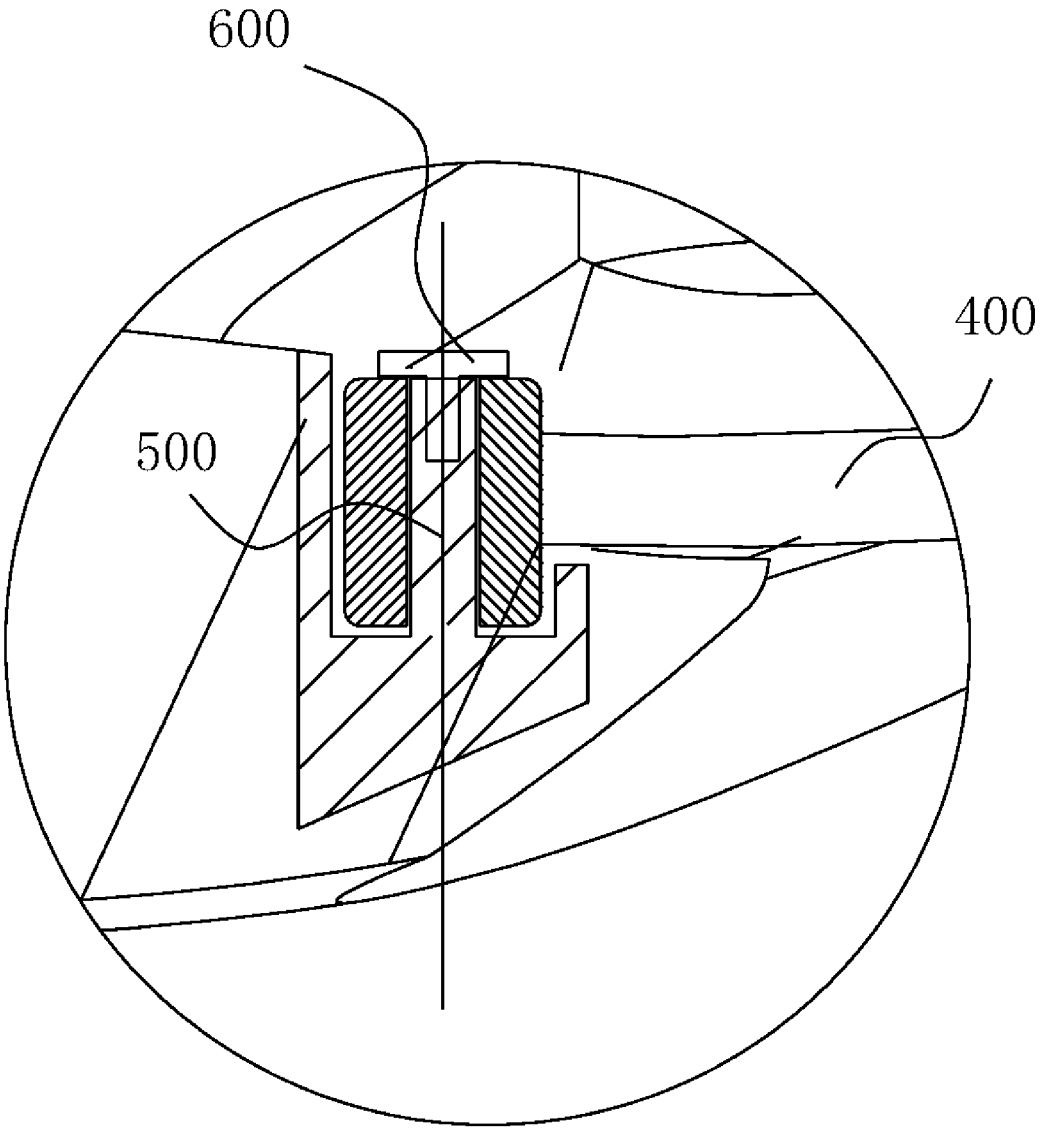
FIG. 6 is a schematic diagram illustrating a structure at I in FIG. 5.

As shown in FIG. 2, the resonant shell and the protective shell in the present embodiment are separated structures and jointly form the helmet body 1. The number of the resonant shell 300 in a specific embodiment of the present disclosure can be one or more. In the case that there are a plurality of resonant shells 300, the plurality of resonant shells 300 are arranged in the helmet body 1 symmetrically, and one bone conduction oscillator is provided for each of the resonant shells 300. A stereophonic effect can be achieved in the helmet body 1 by arranging the plurality of resonant shells 300.

Optionally, there are two resonant shells 300 in the present embodiment, and the two resonant shells 300 are respectively arranged at positions corresponding to ears of a wearer of the helmet, on the helmet body 1.

Embodiment III

The basic structure of the present embodiment is the same as that of embodiment I, and a main difference therebetween lies in that: the helmet body in the present embodiment includes the protective shell and the resonant shell, and the resonant shell is in a hemispheric structure which is suitable for a human head to wear and is arranged at an inner side of the helmet body, the protective shell is disposed outside of the resonant shell, and a side of the resonant shell, which is far away from the protective shell, is provided with a buffer layer.

Since materials required for realizing physical protection and oscillation sound production are different, it is inevitable that the physical protection and the oscillation sound production cannot simultaneously achieve the highest requirement when the helmet body is made of a same material. The helmet in the present embodiment is ensured to better realize the purposes of the present disclosure by arranging the protective shell and the resonant shell individually, and adopting a material with better physical impact resistance for the protective shell and adopting a material with good oscillation sound production performance for the resonant shell. Meanwhile, the arrangement of the buffer layer can prevent the resonance shell and the protective shell made of harder materials from directly contacting the head of the wearer, causing an influence on the use comfort degree.

Embodiment IV

As shown in FIGS. 3-6, in the present embodiment, the cycling helmet capable of switching a sound production guidance mode based on a bone conduction earphone 200, provided in the present disclosure, includes the helmet body 1 and the bone conduction earphone 200 disposed on the helmet body 1. The bone conduction earphone 200 includes the magnet, the coil and the bone conduction oscillator, and the bone conduction oscillator can contact the helmet body 1, so that the helmet body 1 oscillates to form a sound cavity.

The helmet body 1 includes a resonant shell which can directly contact the bone conduction oscillator, and the bone conduction earphone 200 is rotatably connected with the helmet body 1, so that the bone conduction oscillator has a first state of contacting the resonant shell and a second state of contacting the head of the person wearing the helmet.

In the present embodiment, the bone conduction oscillator is configured to be in a state of being rotatably connected with the helmet body 1. When being used, the bone conduction oscillator can be adjusted to a position corresponding to the first state according to the need of a user, so that the resonant shell is driven to oscillate through an oscillation contact between the bone conduction oscillator and the resonant shell, thereby realizing air conduction sound production. Alternatively, the bone conduction oscillator can be adjusted to a second state, so that the bone conduction oscillator is separated from the resonant shell and only contacts the head of the wearer, thereby realizing bond conduction sound production. According to the optional structure, the use flexibility of the helmet can be improved, the user has more options according to different application occasions, and the user experience is improved.

Specifically, the cycling helmet capable of switching the sound production guidance mode based on the bone conduction earphone 200, provided in the present embodiment, further includes a first rotating arm 400. The first rotating arm 400 has a first end connected with the bone conduction earphone 200 and a second end connected with the helmet body 1, and the bone conduction earphone 200 is articulated with the helmet body 1 via the first rotating arm 400.

A rotating shaft 500 is integrally formed on the helmet body 1 in an injection molding manner, a shaft hole matched with the rotating shaft 500 is provided at the second end of the first rotating arm 400, a fixing hole is provided at an end of the rotating shaft 500, and the first rotating arm 400 is axially fixed on the rotating shaft 500 by a fastening screw 600 in a manner of being matched with the fixing hole.

To be sure, the connection manner of the bone conduction earphone 200 and the helmet body 1 is not limited to the articulation form, and other connection manners such as a telescopic connection manner and the like can also be adopted in other embodiments.

Embodiment V

Figure 7:
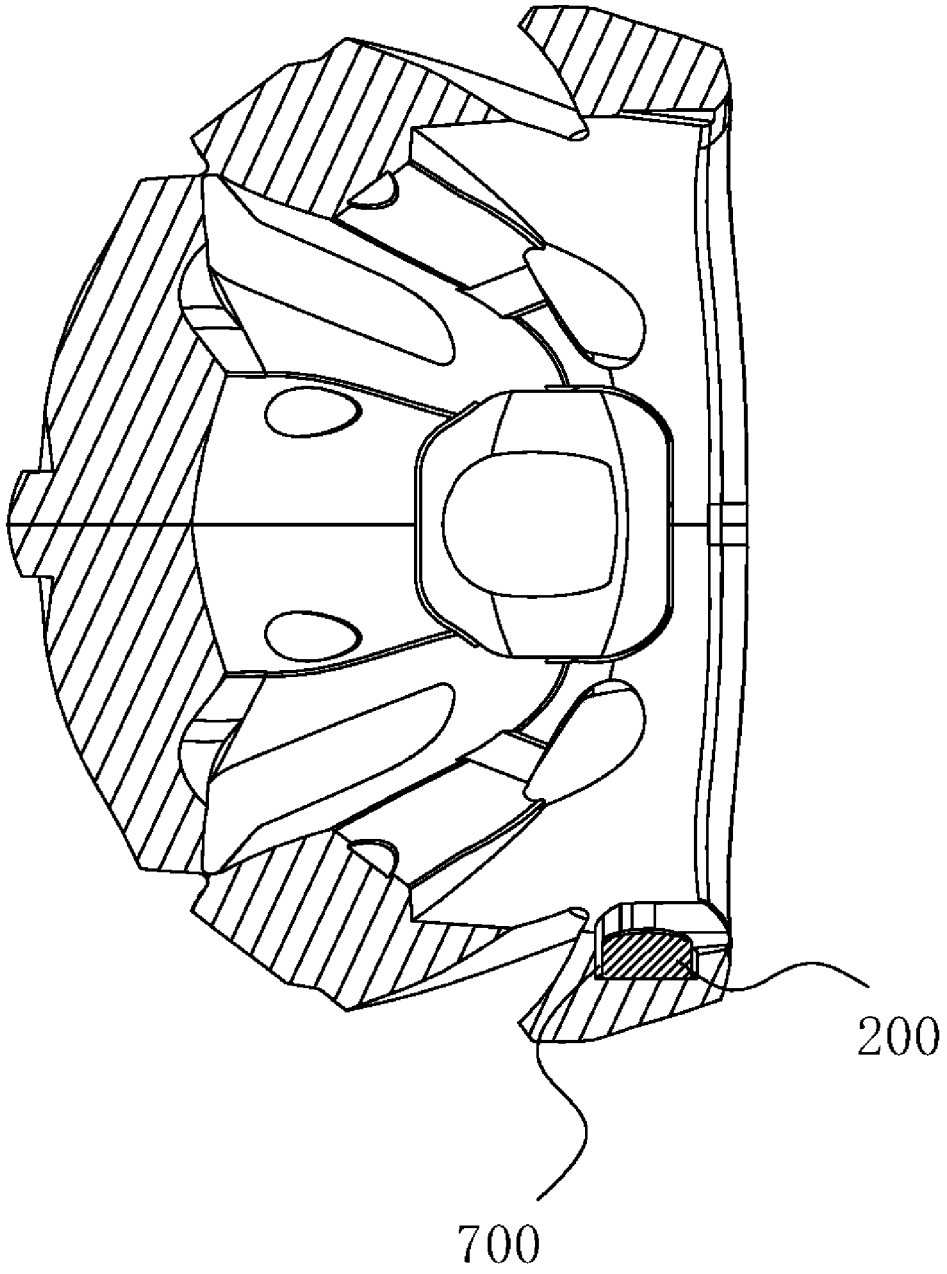
FIG. 7 is a schematic diagram illustrating an internal structure of a cycling helmet capable of switching a sound production guidance mode based on a bone conduction earphone according to embodiment V of the present disclosure.

As shown in FIG. 7, a cycling helmet capable of switching a sound production guidance mode based on a bone conduction earphone 200, provided in the present embodiment, has a substantively same structure as that of the cycling helmet described in embodiment IV, and the differences therebetween mainly lie in: in the present embodiment, a containing cavity 700 for containing the bone conduction earphone 200 in the first state is added on the helmet body 1; at least one side wall of the containing cavity 700 is the resonant shell 300; and in the first state, the bone conduction earphone 200 is located in the containing cavity 700, and the bone conduction oscillator of the bone conduction earphone 200 contacts the resonant shell.

In the case that the helmet is used for bone conduction sound production by a wearer wearing the helmet, the bone conduction earphone 200 is outside of the containing cavity 700, so as to facilitate contacting a human body. In the case that the air conduction sound production function is adopted, the bone conduction earphone 200 is contained in the containing cavity 700, so that the helmet has a concise and good appearance, and the bone conduction earphone 200 is protected to a certain degree, thereby preventing from damaging the bone conduction earphone due to collision.

Embodiment VI

Figure 8:
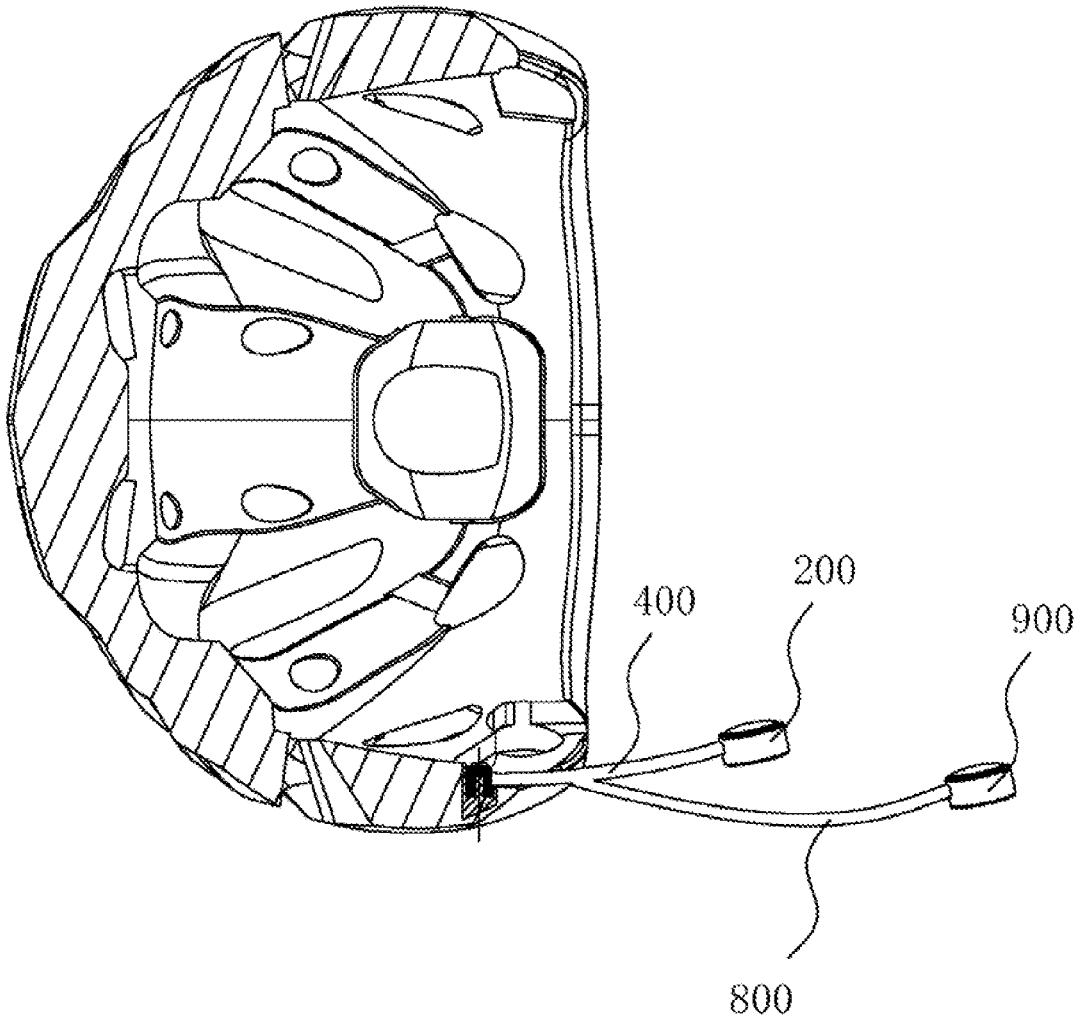
FIG. 8 is a schematic diagram illustrating an internal structure of a cycling helmet capable of switching a sound production guidance mode based on a bone conduction earphone according to embodiment VI of the present disclosure.

As shown in FIG. 8, a cycling helmet capable of switching a sound production guidance mode based on a bone conduction earphone 200, provided in the present embodiment, has a substantively same structure as that of the cycling helmet described in embodiment V, and the differences therebetween mainly lie in: the cycling helmet in the present embodiment further includes a bone conduction microphone 900 and a second rotating arm 800 for connecting the bone conduction microphone 900 and the helmet body 1; the second rotating arm 800 has a first end connected with the bone conduction microphone 900 and a second end connected with the helmet body 1, and the bone conduction microphone 900 is articulated with the helmet body 1 via the second rotating arm 800. The first rotating arm 400 and the second rotating arm 800 are in an integrated structure and are articulated with the helmet body 1 via a same articulating apparatus.

The containing cavity 700 is also arranged in the present embodiment, and the containing cavity 700 can simultaneously contain the first rotating arm 400 and the second rotating arm 800.

Since the speed is usually high in a cycling process, it is difficult to ensure the communication quality due to the effect of the wind when the traditional microphone is adopted in the cycling process. However, the bone conduction microphone 900 is adopted in the present embodiment, so as to effectively avoid wind interference.

In the descriptions of the text, terms 'first' and 'second' are only used for distinguishing the descriptions and do not have special meanings.

It should be declared that, the above specific implementation manners are only preferred embodiments and the applied technical principles of the present disclosure, and any change or replacement easily contemplated by those skilled in the art and acquainted with the technical field within the technical scope disclosed by the present disclosure shall be included in the protection scope of the present disclosure.

What is claimed is:

1. A cycling helmet capable of switching a guidance mode of sound production based on a bone conduction earphone, comprising a helmet body and the bone conduction earphone disposed on the helmet body, wherein the bone conduction earphone comprises a magnet, a coil and a bone conduction oscillator, and the bone conduction oscillator can contact the helmet body, so as to cause the helmet body to oscillate to form a sound cavity;

wherein the helmet body comprises a resonant shell capable of directly contacting the bone conduction oscillator, and the bone conduction earphone is rotatably connected with the helmet body, so that the bone conduction oscillator has a first state of contacting the resonant shell and a second state wherein the bone conduction oscillator is configured to contact a head of a wearer wearing the helmet;

wherein the helmet body is provided with a containing cavity for containing the bone conduction earphone in the first state, at least one side wall of the containing cavity is the resonant shell, and in the first state, the bone conduction earphone is located in the containing cavity, and the bone conduction oscillator of the bone conduction earphone contacts the resonant shell.

2. The cycling helmet capable of switching the sound production guidance mode based on the bone conduction earphone according to claim 1, further comprising a first rotating arm, wherein the first rotating arm has a first end of the first rotating arm and a second end of the first rotating arm, the first end is connected with the bone conduction earphone, the second end is connected with the helmet body, and the bone conduction earphone is articulated with the helmet body via the first rotating arm.

3. The cycling helmet capable of switching the sound production guidance mode based on the bone conduction earphone according to claim 2, further comprising a bone conduction microphone and a second rotating arm for connecting the bone conduction microphone and the helmet body, wherein the second rotating arm has a first end of the second rotating arm and a second end of the second rotating arm, the first end of the second rotating arm is connected with the bone conduction microphone, the second end of the second rotating arm is connected with the helmet body, and the bone conduction microphone is articulated with the helmet body via the second rotating arm.

4. The cycling helmet capable of switching the sound production guidance mode based on the bone conduction earphone according to claim 3, wherein the first rotating arm and the second rotating arm are in an integrated structure and are articulated with the helmet body via a same articulating apparatus.

* * * * *